US008416157B2

(12) United States Patent
Lee et al.

(10) Patent No.: US 8,416,157 B2
(45) Date of Patent: Apr. 9, 2013

(54) ORGANIC LIGHT EMITTING DISPLAY AND DRIVING CIRCUIT THEREOF

(75) Inventors: Hyungjung Lee, Yongin-si (KR); Kyunghoon Chung, Yongin-si (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 1011 days.

(21) Appl. No.: 12/000,618

(22) Filed: Dec. 14, 2007

(65) Prior Publication Data

US 2008/0211745 A1 Sep. 4, 2008

(30) Foreign Application Priority Data

Mar. 2, 2007 (KR) ..... 10-2007-0020737

(51) Int. Cl.
*G09G 3/30* (2006.01)

(52) U.S. Cl. ..... 345/76; 345/82

(58) Field of Classification Search ..... 345/76–83; 377/64

See application file for complete search history.

(56) References Cited

U.S. PATENT DOCUMENTS

| | | | | |
|---|---|---|---|---|
| 5,568,163 | A | 10/1996 | Okumura | |
| 6,127,998 | A | 10/2000 | Ichikawa et al. | |
| 2004/0150610 | A1 * | 8/2004 | Zebedee et al. | 345/100 |
| 2005/0280616 | A1 | 12/2005 | Miwa et al. | |
| 2006/0103323 | A1 | 5/2006 | Eom et al. | |
| 2006/0156118 | A1 * | 7/2006 | Shin | 714/726 |
| 2007/0046608 | A1 | 3/2007 | Chung | |
| 2007/0063950 | A1 | 3/2007 | Shin | |
| 2008/0055227 | A1 * | 3/2008 | Li | 345/100 |
| 2009/0121998 | A1 * | 5/2009 | Ohkawa et al. | 345/100 |

FOREIGN PATENT DOCUMENTS

| | | | |
|---|---|---|---|
| JP | 2003-101394 | A | 4/2003 |
| JP | 2003-150109 | A | 5/2003 |
| JP | 2004-227751 | A | 8/2004 |
| JP | 2006-003744 | A | 1/2006 |
| JP | 2006-126778 | A | 5/2006 |
| KR | 10-0658269 | B1 | 12/2006 |
| KR | 10-0666637 | B1 | 1/2007 |
| WO | WO 2005/122178 | A1 | 12/2005 |

OTHER PUBLICATIONS

Japanese Office Action in JP 2007-177380, dated Nov. 9, 2010, (Lee, et al.)

* cited by examiner

*Primary Examiner* — Chanh Nguyen
*Assistant Examiner* — Jonathan Blancha
(74) *Attorney, Agent, or Firm* — Lee & Morse, P.C.

(57) ABSTRACT

A driving circuit including a plurality of light emitting control drivers includes an input terminal coupled to an initial driving line or a light emitting negative control line of a previous light emitting control driver, a first clock terminal and a second clock terminal that are electrically coupled to a first clock line and a first negative clock line that are phase-inverted, or a second clock line and a second negative clock line, respectively, and an output terminal and a negative output terminal adapted to generate an output signal and a negative output signal when receiving an input signal, a clock signal and a negative clock signal via the input terminal, the first clock terminal and the second clock terminal, respectively.

21 Claims, 7 Drawing Sheets

ORGANIC LIGHT EMITTING DISPLAY AND DRIVING CIRCUIT THEREOF

CROSS REFERENCE TO RELATED APPLICATION

Cross reference is made to concurrently filed U.S. patent application Ser. No. 12/000,617 and titled "Organic Light Emitting Display and Driving Circuit Thereof."

BACKGROUND OF THE INVENTION

1. Field of the Invention

Embodiments of the present invention relate to a light emitting display, e.g., an organic light emitting display, and a driving circuit thereof. More particularly, embodiments of the invention relate to light emitting displays and driving circuits thereof in which a single light emitting control driving line is electrically coupled to multiple, e.g., two, rows of pixels of a display and is capable of simultaneously supplying a light emitting control signal to the multiple, e.g., two, rows of pixels simultaneously and/or substantially simultaneously, i.e., is capable of respectively supplying a light emitting control signal to the multiple, e.g., two, rows of pixels during a same driving period in order to reduce a number of driving circuits, reduce manufacturing cost, and improve yield.

2. Description of the Related Art

In general, an organic light emitting display is a display device that is capable of electrically exciting a light emitting material, e.g., a fluorescent or phosphorescent organic compound, to emit light and display an image by driving N×M organic light emitting diodes (OLEDs). An OLED may include an anode, e.g., indium tin oxide (ITO), an organic thin film, and a cathode, e.g., metal. The organic thin film may include multi-layers, e.g., an emitting layer (EML) in which light is emitted when electrons are combined with holes, an electron transport layer (ETL) in which the electrons are transported, and a hole transport layer (HTL) in which the holes are transported. The organic thin film may further include an electron injecting layer (EIL) in which additional electrons are injected and a hole injecting layer (HIL) in which holes are injected.

Such OLEDs may be driven using a passive matrix method and/or an active matrix method in which an MOS (metal oxide silicon) thin film transistor (TFT) may be used. In the passive matrix method, an anode and a cathode, which extend perpendicular to each other, may be used to select and drive a line. In the active matrix method, each of the TFTs and a capacitor is connected to an ITO pixel electrode to store a voltage using the capacitance of the capacitor.

Such organic light emitting displays may be used as a display device for a variety of devices, e.g., a personal computer, a mobile phone, a portable information terminal, such as a PDA, or a display device for a plurality of information equipment.

A plurality of light emitting display devices that have a relatively lighter-weight and smaller size than cathode ray tube displays have been developed. For example, organic light emitting displays have been developed. The organic light emitting displays also have relatively excellent luminous efficiency, brightness, wide-viewing angle, and fast response speed.

However, as the resolution of the organic light emitting displays increases, the size of a driving unit used to drive the pixels thereof becomes large. To help reduce the size of the organic light emitting display, a dead space is used for the driving unit thereof. However, the amount of dead space of a real product, e.g., an organic light emitting display, is limited. If the size of the driving unit for driving the relatively higher-resolution organic light emitting display becomes larger than the size of the limited dead space, the size of the organic light emitting display increases. Accordingly, there is a problem in that the size of the organic light emitting display may be increased as a result of, e.g., the relatively large size of the driving unit.

Further, many light emitting control driving circuits include both an PMOS transistor(s) and an NMOS transistor (s). Such light emitting control drivers thus require an additional processing step(s) and/or substrate. Accordingly, there is a problem in that the organic light emitting display may become relatively large and heavy, and the processing thereof may become complicated.

SUMMARY OF THE INVENTION

The present invention is therefore directed to providing a light emitting display and a driving circuit thereof that substantially overcome one or more of the problems due to the limitations and disadvantages of the related art.

It is therefore a feature of an embodiment of the present invention to provide a light emitting display, e.g., an organic light emitting display, and a driving circuit thereof in which one light emitting control driving line is electrically coupled to a plurality of, e.g., two, rows of pixels such that a same/single light emitting control signal may be supplied to the respective plurality of, e.g., two, rows of pixels associated therewith during a same driving period, i.e., may be simultaneously and/or substantially simultaneously supplied to the respective plurality of, e.g., two, rows of pixels associated therewith.

It is therefore a separate feature of an embodiment of the present invention to provide a light emitting control driver and a light emitting display, e.g., an organic light emitting display, including such a light emitting control driver that is electrically coupled to a plurality of, e.g., two, rows of pixels and is adapted to simultaneously and/or substantially simultaneously supply a light emitting control signal to the respective plurality of, e.g., two, rows of pixels such that an area of the driving circuit and/or a manufacturing cost may be reduced, and a manufacturing yield thereof may be increased. That is, the light emitting control driver may respectively supply a same single light emitting control signal to each of the plurality of rows of pixels during a same driving period.

It is therefore a separate feature of an embodiment of the present invention to provide a light emitting control driver including only transistors of a same transistor-type that are included in pixels of a light emitting display.

It is therefore a separate feature of an embodiment of the present invention to provide a light emitting control driver and/or a light emitting display, e.g., an organic light emitting display, including such a light emitting control driver having a relatively lower manufacturing cost, a relatively shorter manufacturing time, and/or an improved manufacturing yield.

At least one of the above and other features and advantages of the present invention may be realized by providing an organic light emitting display, including a first light emitting control driver electrically coupled to an initial driving line, a first clock line, and a first negative clock line, and adapted to output a first light emitting control signal via a first light emitting control line, and a first light emitting negative control signal via a first light emitting negative control line, a first pixel unit electrically coupled to the first light emitting control line, a second pixel unit electrically coupled to the first light emitting control line, a second light emitting control driver electrically coupled to the first light emitting negative control line, a second clock line, and a second negative clock line, and adapted to output a second light emitting control signal via a second light emitting control line, and a second light emitting negative control signal via a second light emitting negative control line, a third pixel unit electrically coupled to the second light emitting control line, and a fourth pixel unit electrically coupled to the second light emitting control line.

A first clock terminal of the first light emitting control driver may be electrically coupled to the first clock line, a second clock terminal of the first light emitting control driver may be electrically coupled to the negative clock line, an input terminal of the first light emitting control driver may be electrically coupled to the initial driving line, an output terminal of the first light emitting control driver may be electrically coupled to the first light emitting control line for outputting the first light emitting control signal, and a negative output terminal of the first light emitting control driver may be electrically coupled to the first light emitting negative control line for outputting the first light emitting negative control signal.

A first clock terminal of the second light emitting control driver may be electrically coupled to the second clock line, a second clock terminal of the second light emitting control driver may be electrically coupled to the second negative clock line, an input terminal of the second light emitting control driver may be electrically coupled to the first light emitting negative control line, an output terminal of the second light emitting control driver may be electrically coupled to the second light emitting control line for outputting the second light emitting control signal, and a negative output terminal of the second light emitting control driver may be electrically coupled to the second light emitting negative control line for outputting the second light emitting negative control signal.

The first pixel unit may include pixels of a first row of a panel that are electrically coupled between a first scanning driving line and first to m-th data lines. The second pixel unit may include pixels of a second row of a panel that are electrically coupled between a second scanning driving line and first to m-th data lines. The third pixel unit may include pixels of a third row of a panel that are electrically coupled between a third scanning driving line and first data line to m-th data lines.

The fourth pixel unit may include pixels of a fourth row of a panel that are electrically coupled between a fourth scanning driving line and first data line to m-th data lines. The first pixel unit and the second pixel unit may emit light based on the first light emitting control signal. The third pixel unit and the fourth circuit unit may emit light based on the second light emitting control signal.

At least one of the above and other features and advantages of the present invention may be separately realized by providing a driving circuit including a plurality of light emitting control drivers, including an input terminal coupled to an initial driving line or a light emitting negative control line of a previous light emitting control driver, a first clock terminal and a second clock terminal that are electrically coupled to a first clock line and a first negative clock line that are phase-inverted, or a second clock line and a second negative clock line, respectively, and an output terminal and a negative output terminal adapted to generate an output signal and a negative output signal when receiving an input signal, a clock signal and a negative clock signal via the input terminal, the first clock terminal and the second clock terminal, respectively.

The clock signal may be a signal transferred from the first clock line or the second clock line. The negative clock signal may be a signal transferred from the first negative clock line or the second negative clock line.

Each of the light emitting control drivers may include a first switching element electrically coupled between the input terminal and a first power supply line, a second switching element that includes a control electrode electrically coupled to the first clock terminal, and is electrically coupled between the first switching element and the first power supply line, a third switching element that includes a control electrode electrically coupled between the first switching element and the second switching element, and is electrically coupled between the second switching element and the second clock terminal, a fourth switching element that includes a control electrode electrically coupled between the second switching element and the third switching element, and is electrically coupled between the first power supply line and a second power supply line, a fifth switching element that includes a control electrode electrically coupled to the first clock terminal, and is electrically coupled between the fourth switching element and the second power supply line, a sixth switching element that includes a control electrode electrically coupled between the fourth switching element and the fifth switching element, and is electrically coupled between the first power supply line and a second power supply line, a seventh switching element that includes a control electrode electrically coupled between the second switching element and the third switching element, and is electrically coupled between the sixth switching element and the second power supply line, an eighth switching element that includes a control electrode electrically coupled between the sixth switching element and the seventh switching element, and is electrically coupled between the first power supply line and a second power supply line, and a ninth switching element that includes a control electrode electrically coupled between the fourth switching element and the fifth switching element, and is electrically coupled between the eighth switching element and the second power supply line.

The first clock terminal of a first light emitting control driver of the plurality of light emitting control drivers may be electrically coupled to the first clock line, the second clock terminal of the first light emitting control driver of the plurality of light emitting control drivers may be electrically coupled to the first negative clock line, the input terminal of the first light emitting control driver of the plurality of light emitting control drivers may be electrically coupled to the initial driving line, the output terminal of the first light emitting control driver of the plurality of light emitting control drivers may be electrically coupled to the first light emitting control line for outputting the first light emitting control signal, and the negative output terminal of the first light emitting control driver of the plurality of light emitting control drivers may be electrically coupled to the first light emitting negative control line for outputting the first light emitting negative control signal.

The first clock terminal of a second light emitting control driver of the plurality of light emitting control drivers may be electrically coupled to the second clock line, the second clock terminal of the second light emitting control driver of the plurality of light emitting control drivers may be electrically coupled to the second negative clock line, the input terminal of the second light emitting control driver of the plurality of light emitting control drivers may be electrically coupled to the first light emitting negative control signal, the output terminal of the second light emitting control driver of the plurality of light emitting control drivers may be electrically coupled to the second light emitting control line for outputting the second light emitting control signal, and the negative output terminal of the second light emitting control driver of the plurality of light emitting control drivers may be electrically coupled to the second light emitting negative control line for outputting the second light emitting negative control signal.

In odd-numbered ones of the plurality of light emitting control drivers, except for a first one of the plurality of light emitting control drivers, the first clock terminal may be electrically coupled to the first clock line or the first negative clock line, the second clock terminal is electrically coupled to the first negative clock line or the first clock line, the input terminal may be electrically coupled to the light emitting negative control line of the previous light emitting control driver, the output terminal may be electrically coupled to an odd-numbered light emitting control line for outputting the light emitting control signal, and the negative output terminal may be electrically coupled to the odd-numbered light emitting control line for outputting the light emitting negative control signal.

The first clock terminal of the respective odd-numbered light emitting control drivers may be electrically coupled to the first clock line when the second clock terminal is electrically coupled to the first negative clock line, and the second clock terminal may be electrically coupled to the first clock line when the first clock terminal is electrically coupled to the first negative clock line.

In even-numbered ones of light emitting control drivers, the first clock terminal may be electrically coupled to the second clock line or the second negative clock line, the second clock terminal may be electrically coupled to the second negative clock line or the second clock line, the input terminal may be electrically coupled to the light emitting negative control line of the previous light emitting control driver, the output terminal may be electrically coupled to the even-numbered light emitting control line for outputting the light emitting control signal, and the negative output terminal may be electrically coupled to the even-numbered light emitting control line for outputting the light emitting negative control signal.

In the even-numbered light emitting control drivers, when the first clock terminal is electrically coupled to the second clock line, the second clock terminal may be electrically coupled to the second negative clock line, and when the second clock terminal is electrically coupled to the second clock line, the first clock terminal may be electrically coupled to the second negative clock line.

The control electrode of the first switching element may be electrically coupled to the input terminal, a first electrode thereof may be electrically coupled to the control electrode of the third switching element, and a second electrode thereof may be electrically coupled to the input terminal. The control electrode of the first switching element may be electrically coupled to the first clock terminal, a first electrode thereof may be electrically coupled to the control electrode of the third switching element, and a second electrode thereof may be electrically coupled to the input terminal. The second switching element may include a first electrode electrically coupled to the first power supply line, and a second electrode electrically coupled between the control electrode of the third switching element and the control electrode of the fourth switching element.

The third switching element may include a first electrode electrically coupled between the control electrode of the fourth switching element and the control electrode of the seventh switching element, and a second electrode electrically coupled to the second clock terminal. The fourth switching element may include a first electrode electrically coupled to the first power supply line, and a second electrode electrically coupled between the first electrode of the fifth switching element and the control electrode of the sixth switching element the fifth switching element may include a first electrode electrically coupled between the control electrode of the sixth switching element and the control electrode of the ninth switching element, and a second electrode electrically coupled to the second power supply line. The sixth switching element may include a first electrode electrically coupled to the first power supply line, and a second electrode electrically coupled between the first electrode of the seventh switching element and the control electrode of the eighth switching element.

The seventh switching element may include a first electrode electrically coupled between the control electrode of the eighth switching element and the first light emitting negative control line, and a second electrode electrically coupled to the second power supply line. The eighth switching element may include a first electrode electrically coupled to the first power supply line, and a second electrode electrically coupled to the first light emitting control line.

The ninth switching element may include a first electrode electrically coupled to the first light emitting control line, and a second electrode electrically coupled to the second power supply line.

The driving circuit may include a first storage capacitor including a first electrode electrically coupled to the control electrode of the third switching element and a second electrode electrically coupled between the second switching element and the third switching element. The driving circuit may include a second storage capacitor including a first electrode electrically coupled between the control electrode of the ninth switching element and the control electrode of the sixth switching element, and a second electrode electrically coupled between the eighth switching element, the ninth switching element, and the first power supply line. An organic light emitting display may include such a driving circuit.

BRIEF DESCRIPTION OF THE DRAWINGS

The above and other features and advantages of the present invention will become more apparent to those of ordinary skill in the art by describing in detail exemplary embodiments thereof with reference to the attached drawings, in which.

DETAILED DESCRIPTION OF THE INVENTION

Figure 1:
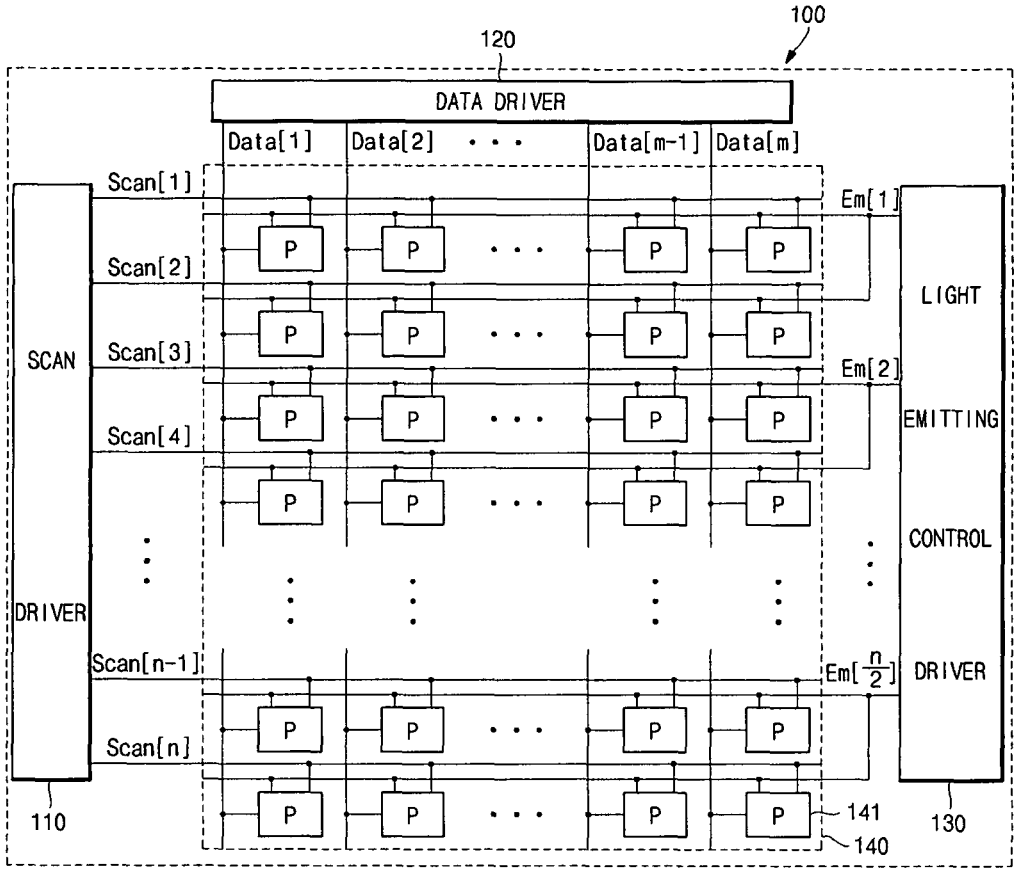
FIG. 1 illustrates a block diagram of an organic light emitting display according to an exemplary embodiment of the invention.

Korean Patent Application No. 10-2007-0020737, filed on Mar. 2, 2007, in the Korean Intellectual Property Office, and entitled: "Organic Light Emitting Display and Driving Circuit Thereof," is incorporated by reference herein in its entirety.

Aspects of the present invention will now be described more fully hereinafter with reference to the accompanying drawings, in which exemplary embodiments of the invention are illustrated. Aspects of the invention may, however, be embodied in different forms and should not be construed as limited to the embodiments set forth herein. Rather, these embodiments are provided so that this disclosure will be thorough and complete, and will fully convey the scope of the invention to those skilled in the art.

Throughout the specification, like reference numerals refer to like elements having similar structures or operations throughout the specification. Further, it will be understood that when one part is described as being electrically coupled to another part, the two parts may be directly connected to each other or may be indirectly connected via other elements positioned or connected therebetween.

FIG. 1 illustrates a block diagram of an organic light emitting display 100 according to an exemplary embodiment of the invention.

As shown in FIG. 1, the organic light emitting display 100 may include a scan driver 110, a data driver 120, a light emitting control driver 130, and an organic light emitting display panel (hereinafter, referred to as panel 140).

The panel 140 may include a plurality of scan lines (Scan[1], Scan[2], . . . , Scan[n]) and a plurality of light emitting control lines (Em[1], Em[2], . . . , Em[n/2]) arranged in a row direction, a plurality of data lines (Data[1], Data[2], . . . , Data[m]) arranged in a column direction, and a plurality of pixels 141 defined by the plurality of scan lines (Scan[1], Scan[2], . . . , Scan[n]), the plurality of data lines (Data[1], Data[2], . . . , Data[m]), and the plurality of light emitting control lines (Em[1], Em[2], . . . , Em[n/2]).

The pixels 141 may be formed in pixel regions defined by respective ones of two adjacent scan lines (Scan[1], Scan[2], . . . , Scan[n]) and two adjacent ones of the data lines (Data[1], Data[2], . . . , Data[m]).

The scan driver 110 may sequentially supply respective scan signals to the panel 140 through the plurality of scan lines (Scan[1], Scan[2], . . . , Scan[n]).

The data driver 120 may sequentially supply respective data signals to the panel 140 through the plurality of data lines (Data[1], Data[2], . . . , Data[m]).

The light emitting control driver 130 may sequentially supply light emitting control signals to the panel 140 through the plurality of light emitting control lines (Em[1], Em[2], . . . , Em[n/2]). The plurality of pixels 141 may be connected to the light emitting control lines (Em[1], Em[2], . . . , Em[n/2]) and may receive the respective light emitting control signals to determine a point of time at which current generated in respective ones of the pixels 141 flows to respective light emitting diode thereof. The pixels 141 may be electrically coupled between the light emitting control lines (Em[1], Em[2], . . . , Em[n/2]) and the scan lines (Scan[1], Scan[2], . . . , Scan[n]). Each of the light emitting control lines (Em[1], Em[2], . . . , Em[n/2]) may be electrically coupled to a plurality of, e.g., two, rows of pixels to simultaneously transfer the respective light emitting signal to the corresponding pixels 141 in the plurality of, e.g., two, rows of pixels associated therewith.

In the description of exemplary embodiments herein, each of the light emitting control lines (Em[1], Em[2], . . . , Em[n/2]) will be described as being connected to two rows of the pixels. Further, in the following description of exemplary embodiments a predetermined group, e.g., a row, of the pixels 141 may be referred to as a pixel unit. However, embodiments of the invention are not limited thereto.

In some embodiments of the invention, e.g., a first light emitting control line (Em[1]) may be electrically coupled to the pixels 141 of first and second pixel units PS_1, PS_2 (see FIG. 2) that may be electrically coupled to the first and second scan lines (Scan[1], Scan[2]) to simultaneously transfer the first light emitting control signal to the pixels 141 of the first and second pixel units PS_1, PS_2. By electrically coupling each of the light emitting control lines (Em[1], Em[2], . . . , Em[n/2]) to two of the scan lines (Scan[1], Scan[2], . . . , Scan[n]), the size of the light emitting control driver 130 according to embodiments of the invention may be reduced to, e.g., one-half of a light emitting control driver having, e.g., a separately driven light emitting control line electrically coupled to each of the scan lines, i.e., a separate light emitting control driving unit for each of the light emitting control lines and each of the scan lines.

Further, the light emitting control driver 130 according to embodiments of the invention may be implemented using transistors of only a same kind as transistors of the pixels 141 such that the light emitting control driver 130 may be formed on a same substrate without additional processing when forming the panel 140 of the light emitting display. Therefore, embodiments of the invention may enable the light emitting control driver 130 to be formed on the same substrate as the pixels 141 without requiring additional processing and/or an additional chip.

Figure 2:
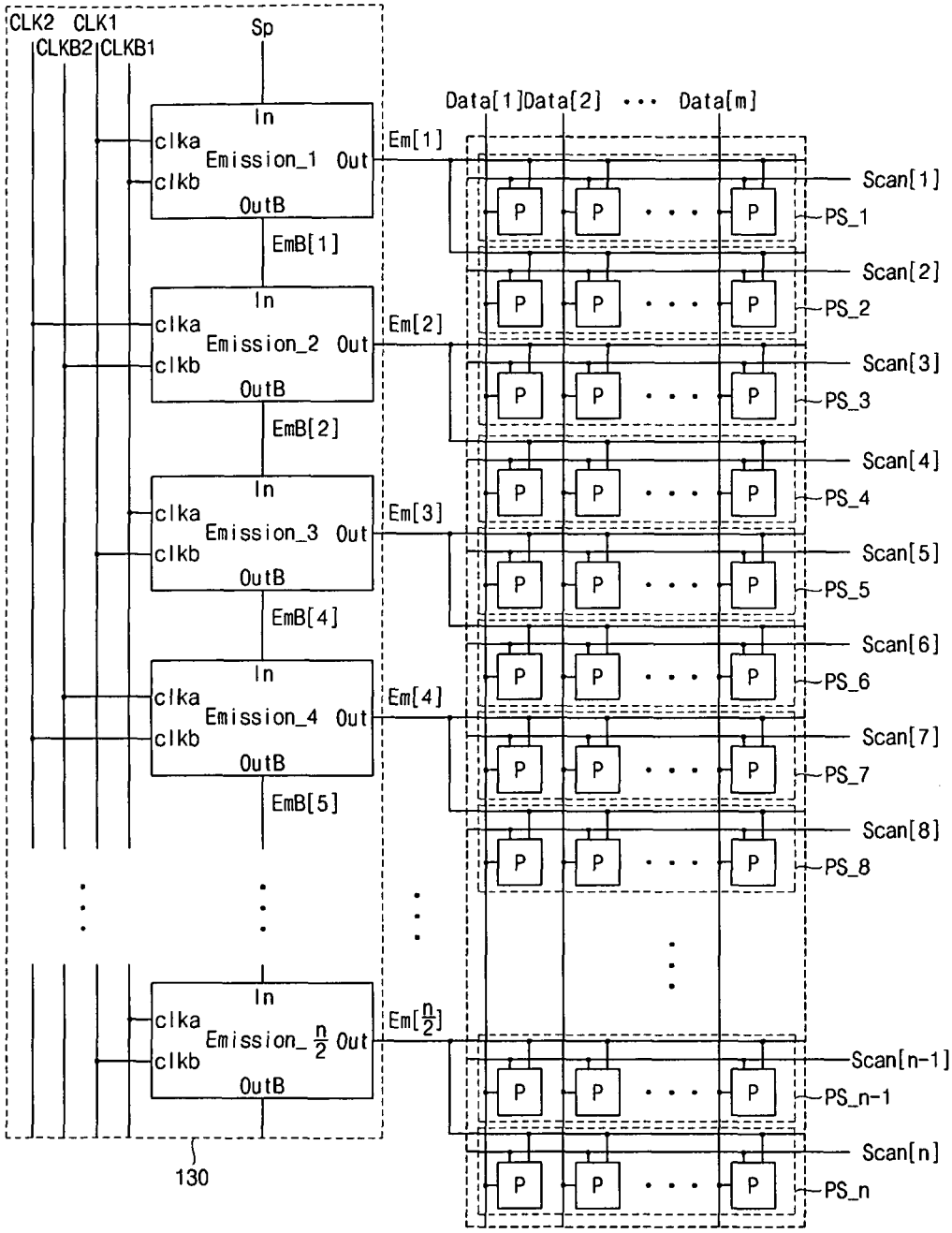
FIG. 2 illustrates a block diagram of an exemplary embodiment of a light emitting control driver employable by the organic light emitting display shown in FIG. 1.

FIG. 2 illustrates a block diagram of an exemplary embodiment of the light emitting control driver 130 employable by the organic light emitting display shown in FIG. 1. As illustrated in FIG. 2, the light emitting control driver 130 may include first to n/2 light emitting control driving units (Emission_1 to Emission_n/2). The first to the n/2 light emitting control driving units (Emission_1 to Emission_n/2) may be electrically coupled to first to nth pixel units (PS_1 to PS_n) to apply a respective light emitting control signal to each of the pixel units (PS_1, PS_2, . . . ,PS_n). More particularly, in embodiments of the invention, each of the n pixel units (PS_1, PS_2, . . . PS_n) may be electrically coupled to a respective one of the n/2 light emitting control driving units (Emission_1, Emission_2, . . . , Emission_n/2), where n may be any positive integer, and multiple ones, e.g., two, of the n pixel units (PS_1, PS_2, . . . PS_n) may be coupled to each of the light emitting control driving units (Emission_1 to Emission_n/2). Thus, embodiments of the invention may enable a size of a light emitting control driver to be reduced to, e.g., one half of a light emitting control driver in which only one pixel unit is electrically coupled to each light emitting control driving unit thereof.

The first light emitting control driving unit (Emission_1) may include a first clock terminal (clka) electrically coupled to a first clock line (CLK1), a second clock terminal (clkb) electrically coupled to a first negative clock line (CLKB1), an input terminal (In) electrically coupled to an initial driving line (Sp), an output terminal (Out) and a negative output terminal (OutB). The input terminal (In) may receive an initial driving signal. The first light emitting control driving unit (Emission_1) may output a first light emitting control signal to a first light emitting control line (Em[1]), which may be electrically coupled to the output terminal (Out) thereof. The first light emitting control driving unit (Emission_1) may also output a first light emitting negative control signal to a first light emitting negative control line (EmB[1]), which may be electrically coupled to the negative output terminal (OutB) thereof.

In some embodiments of the invention, the first light emitting control driving unit (Emission_1) may be electrically coupled to the first pixel unit (PS_1) and the second pixel unit (PS_2), and may apply the first light emitting control signal to the first pixel unit (PS_1) and the second pixel unit (PS_2) respectively. More particularly, the first light emitting control line (Em[1]) may be electrically coupled to the first pixel unit (PS_1) and the second pixel unit (PS_2), and the first light emitting control driving unit (Emission_1) may apply the first light emitting control signal to the first pixel unit (PS_1) and the second pixel unit (PS_2) simultaneously, e.g., respectively during a same driving period.

The second light emitting control driving unit (Emission_2) may include a first clock terminal (clka) electrically coupled to a second clock line (CLK2), a second clock terminal (clkb) electrically coupled to a second negative clock line (CLKB2), an input terminal (In), an output terminal (Out) and a negative output terminal (OutB). The input terminal (In) thereof may be electrically coupled to the first light emitting negative control line (EmB[1]), and may receive the first light emitting negative control signal. The second light emitting control driving unit (Emission_2) may output a second light emitting control signal to a second light emitting control line (Em[2]), which may be electrically coupled to the output terminal (Out) thereof and may output a second light emitting negative control signal to a second light emitting negative control line (EmB[2]), which may be electrically coupled to the negative output terminal (OutB) thereof.

In some embodiments of the invention, the second light emitting control driver (Emission_2) may be electrically coupled to a third pixel unit (PS_3) and a fourth pixel unit (PS_4) via the second light emitting control line (Em[2]), and may apply the second light emitting control signal to the third pixel unit (PS_3) and the fourth pixel unit (PS_4) respectively. More particularly, the second light emitting control driving unit (Emission_2) may apply the second light emitting control signal to the third pixel unit (PS_3) and the fourth pixel unit (PS_4) simultaneously, e.g., respectively during a same driving period.

The third light emitting control driver (Emission_3) may include a first clock terminal (clka) electrically coupled to the first negative clock line (CLKB1), a second clock terminal (clkb) electrically coupled to the first clock line (CLK1), an input terminal (In), an output terminal (Out) and a negative output terminal (OutB). The input terminal (In) thereof may be electrically coupled to the second light emitting negative control line (EmB[2]) and may receive the second light emitting negative control signal. The third light emitting control driving unit (Emission_3) may output a third light emitting control signal to a third light emitting control line (Em[3]), which may be electrically coupled to the output terminal (Out) thereof and may output a third light emitting negative control signal to a third light emitting negative control line (EmB[3]), which may be electrically coupled to the negative output terminal (OutB) thereof.

In some embodiments of the invention, the third light emitting control driving unit (Emission_3) may be electrically coupled to the fifth pixel unit (PS_5) and the sixth pixel unit (PS_6) via the third light emitting control line (Em[3]). The third light emitting control driving unit (Emission_3) may apply the third light emitting control signal to the fifth pixel unit (PS_5) and the sixth pixel unit (PS_6) respectively. More particularly, the third light emitting control driving unit (Emission_3) may apply the third light emitting control signal to the fifth pixel unit (PS_5) and the sixth pixel unit (PS_6) simultaneously, e.g., respectively during a same driving period.

The fourth light emitting control driving unit (Emission_4) may include a first clock terminal (clka) electrically coupled to the second negative clock line (CLKB2), a second clock terminal (clkb) electrically coupled to the second clock line (CLK2), and input terminal (In), an output terminal (Out) and a negative output terminal (OutB). The input terminal (In) may be electrically coupled to the third light emitting negative control line (EmB[3]) and may receive the third light emitting negative control signal. The fourth light emitting control driving unit (Emission_4) may output a fourth light emitting control signal to a fourth light emitting control line (Em[4]), which may be electrically coupled to the output terminal (Out) thereof. The fourth light emitting control driving unit (Emission_4) may output a fourth light emitting negative control signal to the fourth light emitting negative control line (EmB[4]), which may be electrically coupled to the negative output terminal (OutB) thereof.

In some embodiments of the invention, the fourth light emitting control driving unit (Emission_4) may be electrically coupled to a seventh pixel unit (PS_7) and an eighth pixel unit (PS_8), and may apply the fourth light emitting control signal to the seventh pixel unit (PS_7) and the eighth pixel unit (PS_8) respectively. More particularly, the fourth light emitting control driving unit (Emission_4) may apply the fourth light emitting control signal to the seventh pixel unit (PS_7) and the eight pixel unit (PS_8) simultaneously, e.g., respectively during a same driving period.

In some embodiments of the invention, the light emitting control driving units (Emission_1 to Emission_n/2) may be coupled with the pixel units (PS_1 to PS_n) in a pattern following the coupling scheme described above with regard to the first, second, third and fourth light emitting control driving units (Emission_1, Emission_2, Emission_3 and Emission_4).

More particularly, e.g., in some embodiments of the invention, in the odd-numbered light emitting control driving units (Emission_1, Emission_3, Emission_5, etc.), first and second clock terminals (clka, clkb) thereof may be alternately coupled to the first clock line (CLK1) and the first negative clock line (CLKB1). That is, e.g., if the first and second clock terminals (clka, clkb) of the fifth light emitting control driving unit (Emission_5) are respectively electrically coupled to the first clock line (CLK1) and the first negative clock line (CLKB1) thereof, the first and second clock terminals (clka, clkb) of the seventh (e.g., subsequent odd-numbered) light emitting control driving unit (Emission_7) may be respectively electrically coupled to the first negative clock line (CLKB1) and the first clock line (CLK1) thereof.

More particularly, e.g., in some embodiments of the invention, in the even-numbered light emitting control driving units (Emission_2, Emission_4, Emission_6, etc.) first and second clock terminals (clka, clkb) thereof may be alternately coupled to the second clock line (CLK2) and the first negative clock line (CLKB2). That is, e.g., if the first and second clock terminals (clka, clkb) of the sixth light emitting control driving unit (Emission_6) are respectively electrically coupled to the second clock line (CLK2) and the second negative clock line (CLKB2) thereof, the first and second clock terminals (clka, clkb) of the eighth (e.g., subsequent even-numbered) light emitting control driving unit (Emission_8) may be respectively electrically coupled to the second negative clock line (CLKB2) and the second clock line (CLK2) thereof.

Further, with regard to other terminals of the light emitting control driving units, the input terminal (In) thereof may be electrically coupled to the light emitting negative control line of a previous light emitting control driver, a light emitting control signal may be output via the light emitting control line electrically coupled to the output terminal (Out) thereof, and a light emitting negative control signal may be output via the light emitting negative control line of the negative output terminal (OutB) thereof.

Figure 3:
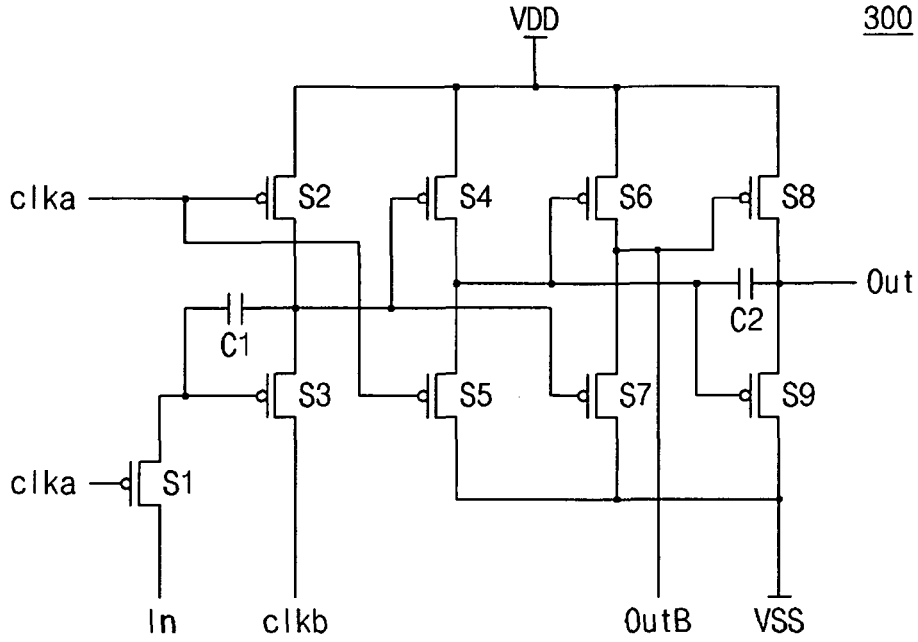
FIG. 3 illustrates a circuit diagram of a light emitting control driving circuit employable by the light emitting control driver shown in FIG. 2.

FIG. 3 illustrates a circuit diagram of a light emitting control driving circuit 300 employable by the light emitting control driver 130 shown in FIG. 2.

More particularly, in some embodiments of the invention, the light emitting control driving circuit 300 may be employed by each of the light emitting control driving units (Emission_1, Emission_2, Emission_n/2). As illustrated in FIG. 3, the light emitting control driving circuit 300 may include a first switching element (S1), a second switching element (S2), a third switching element (S3), a fourth switching element (S4), a fifth switching element (S5), a sixth switching element (S6), a seventh switching element (S7), an eighth switching element (S8), a ninth switching element (S9), a first storage capacitor (C1) and a second storage capacitor (C2).

The first switching element (SI) may include a first electrode (a drain electrode or a source electrode) electrically coupled to a control electrode of the third switching element (S3), a second electrode (a source electrode or a drain electrode) electrically coupled to the input terminal (In) of the respective light emitting control driving unit (e.g., Emission_1), and a control electrode (gate electrode) electrically coupled to the first clock terminal (clka). When a clock signal of a low level is applied to the control electrode of the first switching element (S1), the first switching element (S1) is turned on and thus, a signal applied to the input terminal (In) is applied to the control electrode of the third switching element (S3).

The second switching element (S2) may include a first electrode electrically coupled to the first power supply line (VDD), a second electrode electrically coupled between a first electrode of the third switching element (S3), a control electrode of the fourth switching element (S4) and a control electrode of the seventh switching element (S7), and a control electrode electrically coupled to the first clock terminal (clka). When a clock signal of a low level is applied to the control electrode of the first switching element (S2), the second switching element (S2) is turned on and thus, a first power voltage applied from the first power supply line (VDD) is applied to the control electrode of the fourth switching element (S4) and the control electrode of the seventh switching element (S7).

The third switching element (S3) may include a first electrode electrically coupled between the control electrode of the fourth switching element (S4) and the control electrode of the seventh switching element (S7), a second electrode electrically coupled to the second clock terminal (clkb), and a control electrode electrically coupled to the first electrode of the first switching element (S1). When an input signal of a low level transmitted from the first switching element (S1) is applied to the control electrode of the third switching element (S3), the third switching element (S3) is turned on and thus, the clock signal applied from the second clock terminal (clkb) is applied to the control electrode of the fourth switching element (S4) and the control electrode of the seventh switching element (S7).

The fourth switching element (S4) may include a first electrode electrically coupled to the first power supply line (VDD), a second electrode electrically coupled between the first electrode of the fifth switching element (S5), a control electrode of the sixth switching element (S6) and a control electrode of the ninth switching element (S9), a control electrode electrically coupled between the second switching element (S2) and the third switching element (S3). When an input signal of a low level, e.g., clock signal of a low level, transmitted from the third switching element (S3) is applied to the control electrode of the fourth switching element (S4), the fourth switching element (S4) is turned on and thus, the first power voltage applied from the first power supply line (VDD) is applied to the control electrode of the sixth switching element (S6) and the control electrode of the ninth switching element (S9).

The fifth switching element (S5) may include a first electrode electrically coupled between the control electrode of the sixth switching element (S6) and the control electrode of the ninth switching element (S9), a second electrode electrically coupled to the second power supply line (VSS), and a control electrode electrically coupled to the first clock terminal (clka). When a clock signal of a low level is applied to the control electrode of the fifth switching element (S5), the fifth switching element (S5) is turned on and thus, the second power voltage applied from the second power supply line (VSS) is applied to the control electrode of the sixth switching element (S6) and the control electrode of the ninth switching element (S9).

The sixth switching element (S6) may include a first electrode electrically coupled to the first power supply line (VDD), a second electrode electrically coupled between the first electrode of the seventh switching element (S7), a control electrode of the eighth switching element (S8) and the negative output terminal (OutB) of the respective light emitting control driving unit, e.g., (Emission_1), and a control electrode electrically coupled between the fourth switching element (S4) and the fifth switching element (S5). When the second power voltage transmitted from the fifth switching element (S5) is applied to the control electrode of the sixth switching element (S6), the sixth switching element (S6) is turned on and thus, the first power voltage applied from the first power supply line (VDD) is output to the control electrode of the eighth switching element (S8) and the negative output terminal (OutB).

The seventh switching element (S7) may include a first electrode electrically coupled between the control electrode of the eighth switching element (S8) and the negative output terminal (OutB) of the respective light emitting control driving unit, e.g., (Emission_1), a second electrode electrically coupled to the second power supply line (VSS), and a control electrode electrically coupled between the second switching element (S2) and the third switching element (S3). When a clock signal of a low level transmitted from the third switching element (S3) is applied to the control electrode of the seventh switching element (S7), the seventh switching element (S7) is turned on and thus, the second power voltage applied from the second power supply line (VSS) is output to the control electrode of the eighth switching element (S8) and the negative output terminal (OutB).

The eighth switching element (S8) may include a first electrode electrically coupled to the first power supply line (VDD), a second electrode electrically coupled between the first electrode of the ninth switching element (S9), and the output terminal (Out) of the respective light emitting control driving unit, e.g., (Emission_1), and a control electrode electrically coupled between the sixth switching element (S6) and the seventh switching element (S7). When the second power voltage transmitted from the seventh switching element (S7) is applied to the control electrode of the eighth switching element (S8), the eighth switching element (S8) is turned on and thus, the first power voltage applied from the first power supply line VDD is output to the output terminal (Out).

The ninth switching element (S9) may include a first electrode electrically coupled to the output terminal (Out), a second electrode electrically coupled to the second power supply line (VSS), and a control electrode electrically coupled between the fourth switching element (S4) and the fifth switching element (S5). When the second power voltage transmitted from the fifth switching element (S5) is applied to the control electrode of the ninth switching element (S9), the ninth switching element (S9) is turned on and thus, the second power voltage applied from the second power supply line (VSS) is applied to the output terminal (Out).

The first storage capacitor (C1) may include a first electrode electrically coupled between the first electrode of the first switching element (S1) and the control electrode of the third switching element (S3), and a second electrode electrically coupled between the second switching element (S2) and the third switching element (S3). The first storage capacitor (C1) may store a voltage difference between the first electrode and the control electrode of the third switching element (S3).

The second storage capacitor (C2) may include a first electrode electrically coupled to the control electrode of the ninth switching element (S9), and a second electrode electrically coupled among the eighth switching element (S8), the ninth switching element (S9), and the output terminal (Out) of the respective light emitting control driving unit, e.g., (Emission_1). The second storage capacitor (C2) may store a voltage difference between the first electrode and the control electrode of the ninth switching element (S9).

As shown in FIG. 3, all of the switching elements, e.g., S1, S2, S3, S4, S5, S6, S7, S8 and S9, of the light emitting control driving circuits 300 of the light emitting control driving units (Emission_1 to Emission_n/2) may be of a same type, e.g., p-type transistors such as PMOS transistors. However, embodiments of the invention are not limited thereto as, e.g., all of the switching elements, e.g., S1 to S9, may be, e.g., n-type transistors.

If the pixels 141 of the organic light emitting display include transistors of only a same type as transistors of the light emitting control driving circuits, it is possible to simplify the process of forming the organic light emitting display as the light emitting control driving circuits may be formed on a same substrate as the pixels 141 of the display without requiring additional processing. Further, if the light emitting control driving circuits 300 and the pixels 141 are formed on the same substrate, it is possible to reduce the size, weight, and cost of the organic light emitting display. Accordingly, in some embodiments in which the pixels 141 include, e.g., only p-type transistors, i.e., no n-type transistors, by structuring the light emitting control driving circuit 300 shown in FIG. 3 to include transistors of only p-type, e.g., PMOS transistors, as the first through ninth switching elements (S1 to S9), it is possible to simplify the process of forming the light emitting control driving circuits 300 and the pixels 141 and to form them on a same substrate without requiring additional processing.

Figure 4:
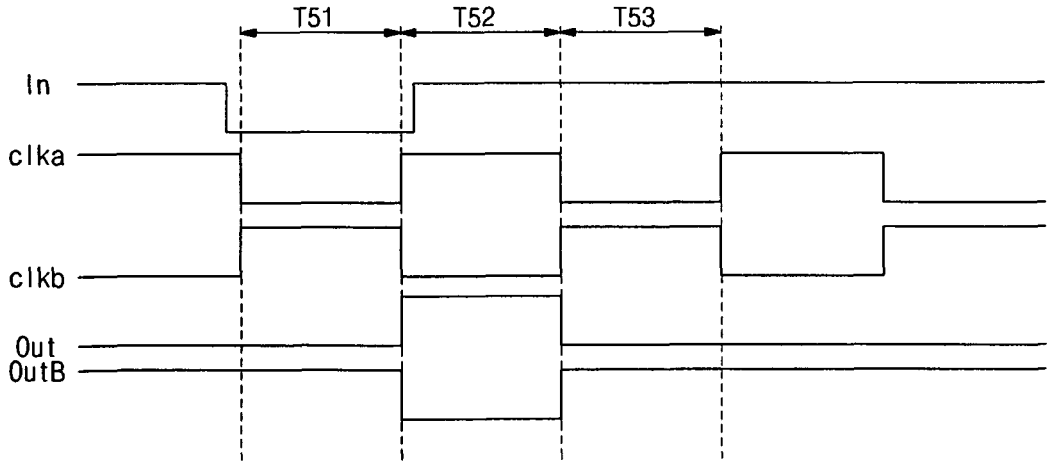
FIG. 4 illustrates a timing diagram of exemplary signals employable for driving the light emitting control driving circuit shown in FIG. 3.

FIG. 4 illustrates a timing diagram of exemplary signals employable for driving the light emitting control driving circuit 300 shown in FIG. 3.

Figure 6:
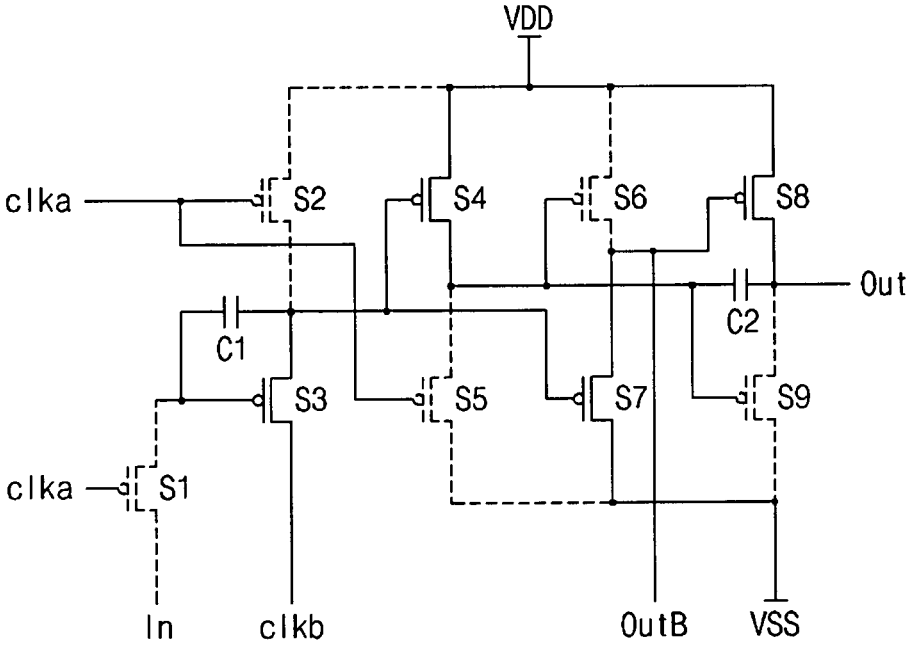
FIG. 6 illustrates a circuit diagram of an operating state of the light emitting control driving circuit shown in FIG. 3 during a second driving period.
Figure 7:
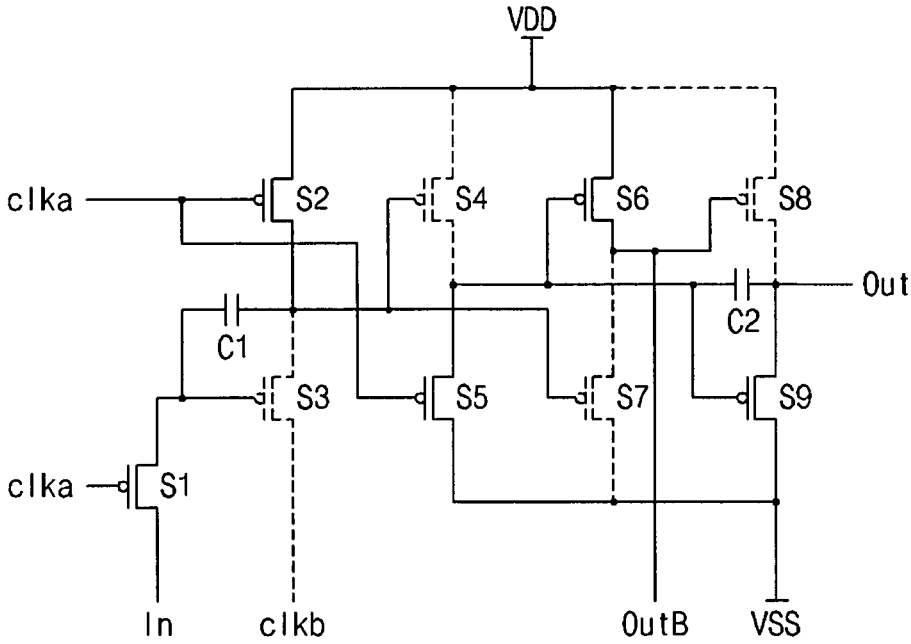
FIG. 7 illustrates a circuit diagram of an operating state of the light emitting control driving circuit shown in FIG. 3 during a third driving period.

As shown in FIG. 4, the timing diagram of the light emitting control driving circuit 300 shown in FIG. 3 may include a first driving period (T51), a second driving period (T52) and a third driving period (T53). Operation of the light emitting control driving circuit 300 will be described below with reference to FIGS. 5, 6 and 7 illustrating respective operating states of the light emitting control driving circuit 300.

Figure 5:
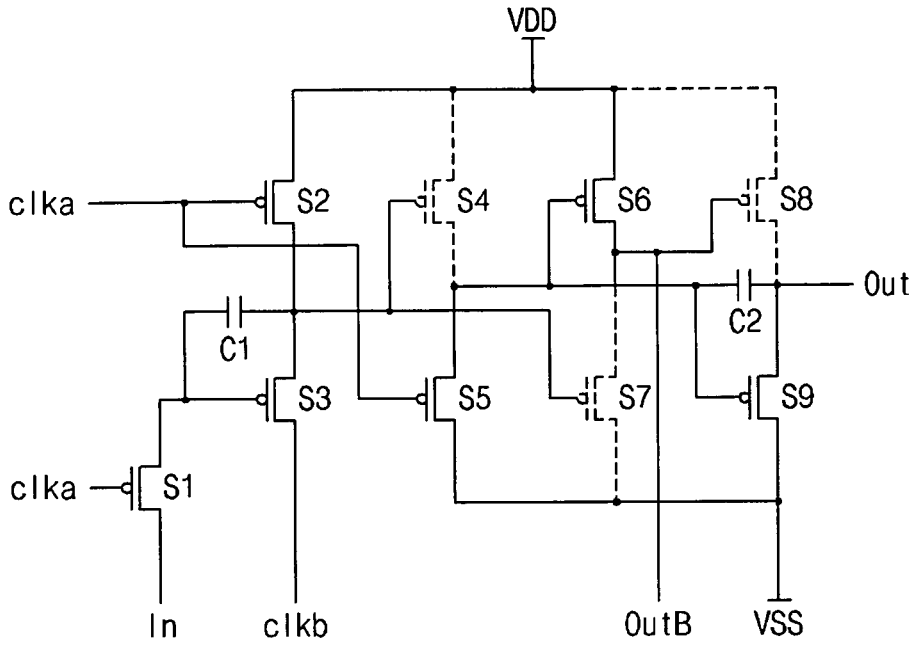
FIG. 5 illustrates a circuit diagram of an operating state of the light emitting control driving circuit shown in FIG. 3 during a first driving period.

More particularly, FIG. 5 illustrates a circuit diagram of an operating state of the light emitting control driving circuit 300 shown in FIG. 3 during the first driving period (T51).

During the first driving period (T51), when a clock signal of a low level is applied to the first clock terminal (clka), the first switching element (S1), the second switching element (S2) and the fifth switching element (S5) are turned on. More particularly, during the first driving period (T51), the first switching element (S1) may be turned on, and then, an input signal of a low level applied to the input terminal (In) may be applied to the control electrode of the third switching element (S3). When the third switching element (S3) receives the input signal at the low level, the third switching element (S3) is turned on and supplies a clock signal at a high level supplied from a second clock terminal (clkb) to the control electrode of the fourth switching element (S4) and the control electrode of the seventh switching element (S7).

During the first driving period (T51), the second switching element (S2) is also turned on and applies the first power voltage of the first power supply line (VDD) to the control electrode of the fourth switching element (S4) and the control electrode of the seventh switching element (S7). As a result, the fourth switching element (S4) and the seventh switching element (S7) receiving the clock signal at the high level and the first power voltage of a high level are turned off. Accordingly, the first storage capacitor (C1) coupled between the first electrode and the control electrode of the third switching element (S3) may store a voltage corresponding to a voltage difference between the first power voltage received from the second switching element (S2) and the input signal received from the first switching element (S1).

Further, during the first driving period (T51), the fifth switching element (S5) is turned on and applies the second power voltage of the second power supply line (VSS) to the control electrode of the sixth switching element (S6) and the control electrode of the ninth switching element (S9) such that the sixth switching element (S6) and the ninth switching element (S9) are turned on. When the sixth switching element (S6) is turned on, the sixth switching element (S6) applies the first power voltage of the first power supply line (VDD) to the control electrode of the eighth switching element (S8) and the negative output terminal (OutB) such that the eighth switching element (S8) is turned off and the first power voltage is output through the negative output terminal (OutB). Further, the ninth switching element (S9) is turned on and outputs the second power voltage of the second power supply line (VSS) to the output terminal (Out). As a result, the second storage capacitor (C2) may store a voltage corresponding to the voltage difference between the second power voltage received from the fifth switching element (S5) and the second power voltage received from the ninth switching element (S9). The voltage stored in the second storage capacitor (C2) may be used to compensate for voltage lost in the driving circuit 300 when the second power voltage is output.

FIG. 6 illustrates a circuit diagram of an operating state of the light emitting control driving circuit 300 shown in FIG. 3 during the second driving period (T52).

During the second driving period (T52), when a clock signal at a high level is supplied to the first clock terminal (clka), the first switching element (S1), the second switching element (S2), and the fifth switching element (S5) are turned off. At this time, the third switching element (S3) is turned on by the voltage stored in the first storage capacitor (C1) during the first driving period (T51) and supplies the clock signal at a low level supplied from the second clock terminal (clkb) to the control electrode of the fourth switching element (S4) and the control electrode of the seventh switching element (S7). The fourth switching element (S4) and the seventh switching element (S7) are turned on by receiving the clock signal at the low level. The fourth switching element (S4) is turned on and applies the first power voltage of the first power supply line (VDD) to the control electrode of the sixth switching element (S6) and the control electrode of the ninth switching element (S9) such that the sixth switching element (S6) and the ninth switching element (S9) are turned off.

Further, during the second driving period (T52), the seventh switching element (S7) is turned on and applies the second power voltage of the second power supply line (VSS) to the control electrode of the eighth switching element (S8) and the negative output terminal (OutB) such that the eighth switching element (S8) is turned on and the second power voltage is output through the negative output terminal (OutB). Further, the eighth switching element (S8) is turned on and outputs the first power voltage of the first power supply line (VDD) to the output terminal (Out). At this time, the second storage capacitor (C2) may store the voltage corresponding to the voltage difference between the first power voltage received from the fourth switching element (S4) and the first power voltage received from the eighth switching element (S8). The voltage stored in the second storage capacitor (C2) may be used to compensate for voltage lost in the driving circuit when the first power voltage is output. Since the first switching element (S1) is turned off, the light emitting control driving circuit 300 operates without any change regardless of whether the input signal supplied to the input terminal (In) is at a high level or at a low level.

FIG. 7 illustrates a circuit diagram of an operating state of the light emitting control driving circuit 300 shown in FIG. 3 during the third driving period (T53).

During the third driving period (T53), when a clock signal at a low level is supplied to the first clock terminal (clka), the first switching element (S1), the second switching element (S2), and the fifth switching element (S5) are turned on. The first switching element (S1) is turned on and supplies an input signal at a high level transferred from the input terminal (In) to the control electrode of the third switching element (S3) such that the third switching element (S3) is turned off.

Further, during the third driving period (T53), the second switching element (S2) is turned on and applies the first power voltage of the first power supply line (VDD) to the control electrode of the fourth switching element (S4) and the control electrode of the seventh switching element (S7). The fourth switching element (S4) and the seventh switching element (S7) are turned off due to the first power voltage received from the second switching element (S2).

Further, during the third driving period (T53), the fifth switching element (S5) is turned on and applies the second power voltage of the second power supply line (VSS) to the control electrode of the sixth switching element (S6) and the control electrode of the ninth switching element (S9) such that the sixth switching element (S6) and the ninth switching element (S9) are turned on. When the sixth switching element (S6) is turned on, the sixth switching element (S6) applies the first power voltage of the first power supply line (VDD) to the control electrode of the eighth switching element (S8) and the negative output terminal (OutB) such that the eighth switching element (S8) is turned off and the first power voltage is output through the negative output terminal (OutB). Further, the ninth switching element (S9) is turned on and outputs the second power voltage of the second power supply line (VSS) to the output terminal (Out). At this time, the second storage capacitor (C2) stores the voltage corresponding to the voltage difference between the second power voltage received from the fifth switching element (S5) and the second power voltage received from the ninth switching element (S9). The voltage stored in the second storage capacitor (C2) may be used to compensate for voltage lost in the driving circuit 300 when the second power voltage is output.

Figure 8:
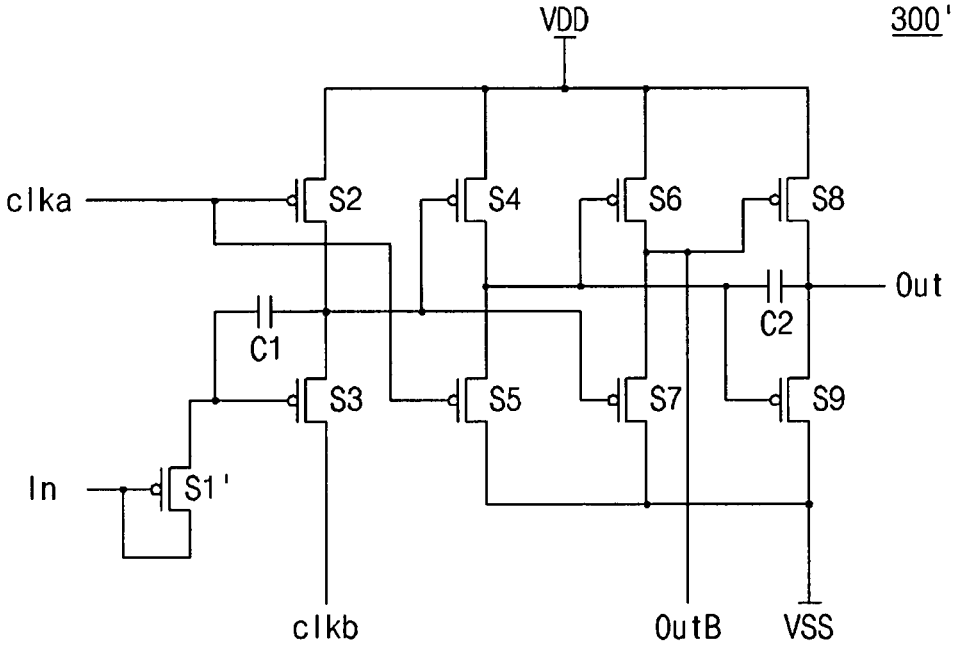
FIG. 8 illustrates a circuit diagram of another exemplary embodiment of a light emitting control driving circuit employable by the light emitting control driver shown in FIG. 2.

FIG. 8 illustrates a circuit diagram of another exemplary embodiment of a light emitting control driving circuit 300' employable by the light emitting control driver shown in FIG. 2.

More particularly, in embodiments of the invention, the light emitting control driving circuit 300' may be employed by each of the light emitting control driving units (Emission_1, Emission_2, Emission_n/2). In general, only differences between the first exemplary light emitting control driving circuit 300 shown in FIG. 3 and the second exemplary light emitting control driving circuit 300' shown in FIG. 8 will be described below.

As shown in FIG. 8, the light emitting control driving circuit 300' may include a first switching element (S1'), the second through ninth switching elements (S2 through S9), the first storage capacitor (C1), and the second storage capacitor (C2).

The first switching element (S1') may include a first electrode (drain electrode or source electrode) electrically coupled to a control electrode of the third switching element (S3), a second electrode (source electrode or drain electrode) electrically coupled to the input terminal (In), and a control electrode (gate electrode) electrically coupled to the input terminal (In). When a clock signal at a low level is supplied to the control electrode, the first switching element (S1') is turned on to supply an input signal supplied from the input terminal (In) to the control electrode of the third switching element (S3).

The coupling scheme of the second through ninth switching elements (S2 through S9), the first storage capacitor (C1) and the second storage capacitor (C2) corresponds to the coupling scheme described above with regard to the first exemplary light emitting control driving circuit 300 shown in FIG. 3.

Figure 9:
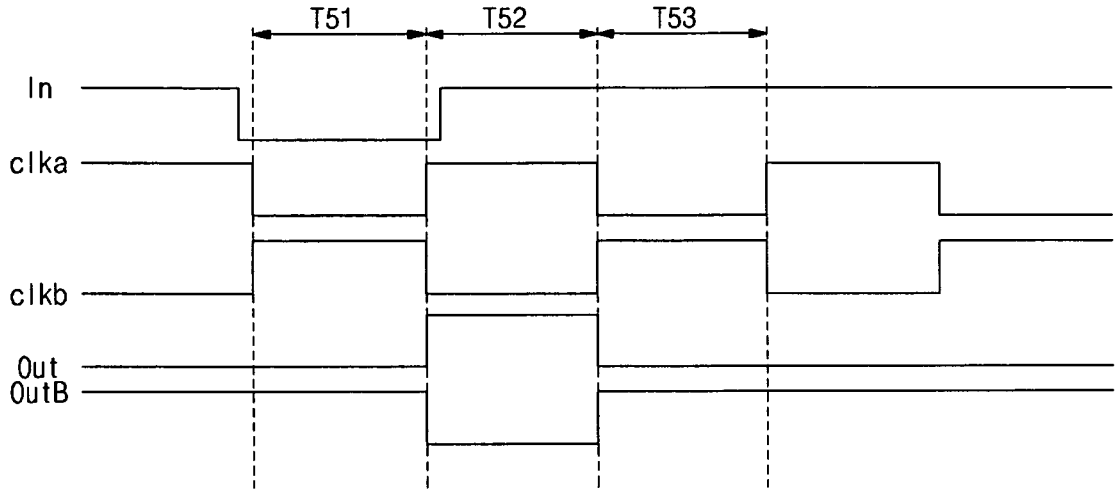
FIG. 9 illustrates a timing diagram of exemplary signals employable for driving the light emitting control driving circuit shown in FIG. 8; and illustrates a timing diagram of exemplary signals employable for driving the light emitting control driving circuit shown in FIG. 8.

FIG. 9 illustrates a timing diagram of exemplary signals employable for driving the light emitting control driving circuit 300' shown in FIG. 8.

As shown in FIG. 9, in embodiments of the invention, like the timing diagram of the light emitting control driving circuit 300 shown in FIG. 5, the timing diagram of the exemplary signals employable for driving light emitting control driving circuit 300' shown in FIG. 8 may include the first driving period (T51), the second driving period (T52), and the third driving period (T53).

During the first driving period (T51), when an input signal at a low level is supplied to the input terminal (In), the first switching element (S1') is turned on and a clock signal at a low level is supplied to the first clock terminal (clka) such that the second switching element (S2) and the fifth switching element (S5).are turned on. First, the first switching element (S1') is turned on to supply an input signal at the low level supplied from the input terminal (In) to the control electrode of the third switching element (S3). When the third switching element (S3) receives the input signal at the low level, the third switching element (S3) is turned on and supplies a clock signal at a high level supplied from a second clock terminal (clkb) to the control electrode of the fourth switching element (S4) and the control electrode of the seventh switching element (S7). The fourth switching element (S4) and the seventh switching element (S7), which receive the clock signal at the high level and the first power voltage, are turned off. The first storage capacitor (C1) coupled between the first electrode and the control electrode of the third switching element (S3) may store a voltage corresponding to the voltage difference of the first power voltage received from the second switching element (S2) and the input signal received from the first switching element (S1').

Next, the fifth switching element (S5) is turned on and applies the second power voltage of the second power supply line (VSS) to the control electrode of the sixth switching element (S6) and the control electrode of the ninth switching element (S9) such that the sixth switching element (S6) and the ninth switching element (S9) are turned on. When the sixth switching element (S6) is turned on, the sixth switching element (S6) applies the first power voltage of the first power supply line (VDD) to the control electrode of the eighth switching element (S8) and the negative output terminal (OutB) such that the eighth switching element (S8) is turned off and the first power voltage is output through the negative output terminal (OutB). Further, the ninth switching element (S9) is turned on and outputs the second power voltage of the second power supply line (VSS) to the output terminal (Out). At this time, the second storage capacitor (C2) may store the voltage corresponding to the voltage difference between the second power voltage received from the fifth switching element (S5) and the second power voltage received from the ninth switching element (S9). The voltage stored in the second storage capacitor (C2) may be used to compensate for voltage lost in the driving circuit 300' when the second power voltage is output.

During the second driving period (T52), when an input signal at a high level is supplied to the input terminal (In), the first switching element (S1') is turned off. Further, when the clock signal at a high level is supplied to the first clock terminal (clka), the second switching element (S2) and the fifth switching element (S5) are turned off. At this time, the third switching element (S3) is turned on with the voltage stored in the first storage capacitor (C1) during the first driving period (T51), and supplies the clock signal at a low level supplied from the second clock terminal (clkb) to the control electrode of the fourth switching element (S4) and the control electrode of the seventh switching element (S7). The fourth switching element (S4) and the seventh switching element (S7) receive the clock signal at the low level and are turned on. First, the fourth switching element (S4) is turned on and applies the first power voltage of the first power supply line (VDD) to the control electrode of the sixth switching element (S6) and the control electrode of the ninth switching element (S9) such that the sixth switching element (S6) and the ninth switching element (S9) are turned off.

Next, the seventh switching element (S7) is turned on and applies the second power voltage of the second power supply line (VSS) to the control electrode of the eighth switching element (S8) and the negative output terminal (OutB) such that the eighth switching element (S8) is turned on and the second power voltage is output through the negative output terminal (OutB). Further, the eighth switching element (S8) is turned on and outputs the first power voltage of the first power supply line (VDD) to the output terminal (Out). At this time, the second storage capacitor (C2) stores the voltage corresponding to the voltage difference between the first power voltage received from the fourth switching element (S4) and the first power voltage received from the eighth switching element (S8). The voltage stored in the second storage capacitor (C2) may be used to compensate for the voltage lost in the driving circuit 300' when the first power voltage is output. Further, since the first switching element (S1') is turned off, the light emitting control driving circuit 300' operates without any change regardless of whether the input signal to be supplied to the input terminal (In) is at a high level or at a low level.

During the third driving period (T53), when the input signal at a high level is supplied to the input terminal (In), the first switching element (S1') is turned off. Further, when the clock signal at a low level is supplied to the first clock terminal (clka), the second switching element (S2) and the fifth switching element (S5) are turned on. When the second switching element (S2) is turned on, the first power voltage of the first power supply line (VDD) is applied to the control electrode of the fourth switching element (S4) and the control electrode of the seventh switching element (S7). The fourth switching element (S4) and the seventh switching element (S7) are turned off due to the first power voltage received from the second switching element (S2). When the fifth switching element (S5) is turned on, the second power voltage of the second power supply line (VSS) is applied to the control electrode of the sixth switching element (S6) and the control electrode of the ninth switching element (S9) such that the sixth switching element (S6) and the ninth switching element (S9) are turned on. When the sixth switching element (S6) is turned on, the sixth switching element (S6) applies the first power voltage of the first power supply line (VDD) to the control electrode of the eighth switching element (S8) and the negative output terminal (OutB) such that the eighth switching element (S8) is turned off and the first power voltage is output through the negative output terminal (OutB). Further, the ninth switching element (S9) is turned on and outputs the second power voltage of the second power supply line (VSS) to the output terminal (Out). At this time, the second storage capacitor (C2) stores the voltage corresponding to the voltage difference between the second power voltage received from the fifth switching element (S5) and the second power voltage received from the ninth switching element (S9). The voltage stored in the second storage capacitor (C2) may be used to compensate for voltage lost in the driving circuit 300' when the second power voltage is output.

Figure 10:
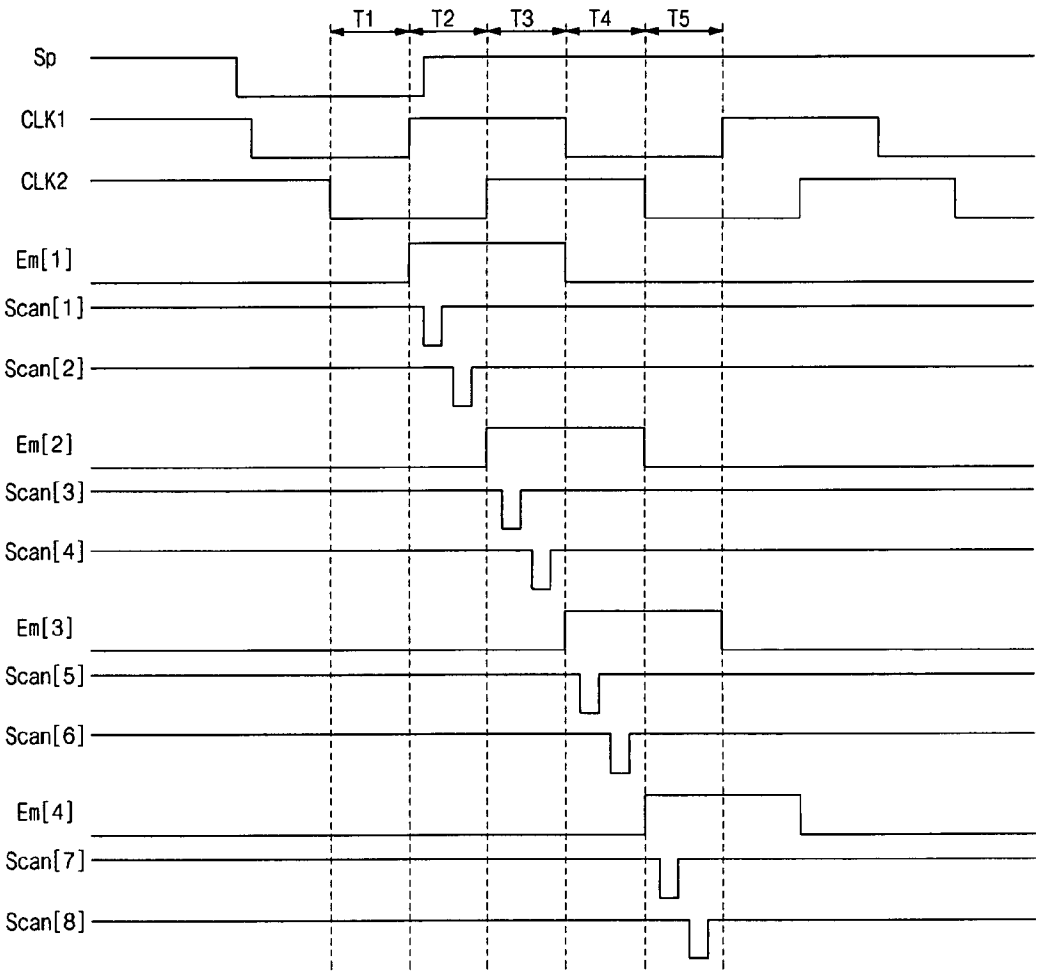
FIG. 10 illustrates a timing diagram of exemplary signals employable for driving the light emitting control driver shown in FIG. 2.

FIG. 10 illustrates a timing diagram of exemplary signals employable for driving the light emitting control driver 130 shown in FIG. 2.

As described above, the light emitting control driver 130 described below may include, e.g., the light emitting control driving circuit 300 and/or 300' described in FIGS. 3 and 8. That is, operation of the first light emitting control driving unit (Emission_1) to the n/2-th light emitting control driving unit (Emission_n/2) may be the same as described with regard to the timing diagrams illustrated in FIGS. 4 and 9.

As illustrated in FIG. 10, the timing chart of the light emitting control driver 130 may include the first driving period (T1), the second driving period (T2), the third driving period (T3), the fourth driving period (T4) and the fifth driving period (T5).

As described above, the first light emitting control driving unit (Emission_1) may include a first clock terminal (clka) electrically coupled to the first clock line (CLK1), a second clock terminal (clkb) electrically coupled to the first negative clock line (CLKB1), and an input terminal (In) electrically coupled to the initial driving line (Sp).

During the first driving period (T1), the first light emitting control driving unit (Emission_1) may receive a first clock signal at a low level, a first negative clock signal of a high level, and an initial driving signal at a low level, and may output a first light emitting control signal at a low level to the first light emitting control line (Em[1]) of an output terminal (Out) thereof, and may output the first light emitting negative control signal at a high level to the first light emitting negative control line (EmB[1]) of a negative output terminal (OutB) thereof. Thus, in embodiments of the invention, during the first driving period (T1), the operation of the first light emitting control driving unit (Emission_1) may be same as the operation of the light emitting control driving circuit 300 and/or 300' during the first driving period (T51), as described with reference to FIGS. 4 and 9.

During the second driving period (T2), the first light emitting control driving unit (Emission_1) may receive a first clock signal at a high level, a first negative clock signal at a low level, and an initial driving signal at a high level, may output the first light emitting control signal of a high level to the first light emitting control line (Em[1]) via the output terminal (Out) thereof, and may output the first light emitting negative control signal at a low level to the first light emitting negative control line (EmB[1]) via the negative output terminal (OutB) thereof. Thus, in embodiments of the invention, during the second driving period (T2), the operation of the first light emitting control driving unit (Emission_1) may be same as the operation of the light emitting control driving circuit 300 and/or 300' during the second driving period (T52), as described with reference to FIGS. 4 and 9.

Further, during the second driving period (T2), when the first light emitting control signal at a high level may be output by the first light emitting control driving unit (Emission_1) to the first light emitting control line (Em[1]), the first pixel unit (PS_1) and the second pixel unit (PS_2) may operate when they respectively receive a scan signal at a low level from the first scan line (Scan[1]) and the second scan line (Scan[2]).

As described above, the second light emitting control driving unit (Emission_2) may include a first clock terminal (clka) electrically coupled to the second clock line (CLK2), a second clock terminal (CLKB) electrically coupled to the second negative clock line (CLKB2), and an input terminal (In) electrically coupled to the first light emitting negative control line (EmB[1]).

During the second driving period (T2), the second light emitting control driving unit (Emission_2) may receive the second clock signal at a low level, a second negative clock signal at a high level, and a first light emitting negative control signal at a low level, may output the second light emitting control signal at a low level to the second light emitting control line (Em[2]) of the output terminal (Out) thereof, and may output the second light emitting negative control signal of a high level is output to the second light emitting negative control line (EmB[2]) of the negative output terminal (OutB) thereof. Thus, in embodiments of the invention, during the second driving period (T2), the operation of the second light emitting control driving unit (Emission_2) may be the same as the operation of the light emitting control driving circuit 300, 300' during the first driving unit (T51), as described with reference to FIGS. 4 and 9.

During the third driving period (T3), the first light emitting control driving unit (Emission_1) may operate in a same manner as it operated during the second driving period (T2).

During the third driving period (T3), a second clock signal at a high level, a second negative clock signal at a low level, and a first light emitting negative control signal at a low level may be applied to the second light emitting control driving unit (Emission_2), and the second light emitting control driving unit (Emission_2) may output the second light emitting control signal at a high level to the second light emitting control line (Em[2]) via the output terminal (Out) thereof, and the second light emitting negative control signal at a low level to the second light emitting negative control line (EmB[2]) via the negative output terminal (OutB) thereof. Thus, in embodiments of the invention, during the third driving period (T3), the operation of the second light emitting control driving unit (Emission_2) may be the same as the operation of the light emitting control driving circuit 300, 300' during the second driving period (T52) described with reference to FIGS. 4 and 9.

Further, during the third driving period (T3), when the second light emitting control signal at a high level may be output by the second light emitting control driving unit (Emission_2) to the second light emitting control line (Em [2]), the third pixel unit (PS_3) and the fourth pixel unit (PS_4) may operate when they respectively receive a scan signal at a low level from the third scan line (Scan[3]) and the fourth scan line (Scan[4]).

As described above, the third light emitting control driving unit (Emission_3) may include a first clock terminal (clka) electrically coupled to the first negative clock line (CLKB1), a second clock terminal (clkb) electrically coupled to the first clock line (CLK1), and an input terminal (In) electrically coupled to the second light emitting negative control line (EmB[2]).

During the third driving period (T3), the third light emitting control driving unit (Emission_3) may receive a first clock signal at a high level, a first negative clock signal at a low level, and a second light emitting negative control signal at a low level, and the third light emitting control driving unit (Emission_3) may output the third light emitting control signal at a low level to the third light emitting control line (Em[3]) via the output terminal (Out) thereof, and the third light emitting negative control signal at a high level to the third light emitting negative control line (EmB[3]) via the negative output terminal (OutB) thereof. Thus, in embodiments of the invention, during the third driving period (T3), the operation of the third light emitting control driving unit (Emission_3) may be the same as the operation of the light emitting control driving circuit 300, 300' during the first driving period (T51), as described with regard to FIGS. 4 and 9.

During the fourth driving period (T4), a first clock signal at a low level, a first negative clock signal at a high level, and an initial driving signal of a high level may be applied to the first light emitting control driving unit (Emission_1), and the first light emitting control driving unit (Emission_1) may output the first light emitting control signal at a low level to the first light emitting control line (Em[1]) via the output terminal (Out) thereof, and may output the first light emitting negative control signal at a high level to the first light emitting negative control line (EmB[1]) via the negative output terminal (OutB)

thereof. Thus, in embodiments of the invention, during the fourth driving period (T4), the operation of the first light emitting control driving unit (Emission_1) may be the same as the operation of the light emitting control driving circuit 300, 300' during the third driving period (T53), as described with reference to FIGS. 4 and 9.

During the fourth driving period (T4), the second light emitting control driving unit (Emission_2) may operate in a same manner as it operated during the third driving period (T3).

During the fourth driving period (T4), the third light emitting control driving unit (Emission_3) may receive a first clock signal at a low level, a first negative clock signal at a high level, and a second light emitting negative control signal at a high level, and the third light emitting control driving unit (Emission_3) may output the third light emitting control signal at a high level to the third light emitting control line (Em[3]) via the output terminal (Out) thereof, and the third light emitting negative control signal at a low level to the third light emitting negative control line (EmB[3]) via the negative output terminal (OutB) thereof. Thus, in embodiments of the invention, during the fourth driving period (T4), the operation of the third light emitting control driving unit (Emission_3) may be the same as the operation of the light emitting control driving circuit 300, 300' during the second driving period (T52), as described in FIGS. 4 and 9.

Further, during the fourth driving period (T4), when the third light emitting control signal at a high level is output to the third light emitting control line (Em[3]) by the third light emitting control driving unit (Emission_3), the fifth pixel unit (PS_5) and the sixth pixel unit (PS_6 ) may operate when they respectively receive a scan line at a low level from the fifth scan line (Scan[5]) and the sixth scan line (Scan[6]).

As described above, the fourth light emitting control driving unit (Emission_4) may include a first clock terminal (clka) electrically coupled to the second negative clock line (CLKB2), a second clock terminal (clkb) electrically coupled to the second clock line (CLK2), and an input terminal (In) electrically coupled to the third light emitting negative control line (EmB[3]).

During the fourth driving period (T4), the fourth light emitting control driving unit (Emission_4) may receive a second clock signal at a high level, a second negative clock signal of a low level, and a third light emitting negative control signal at a low level, and the fourth light emitting control driving unit (Emission_4) may output the fourth light emitting control signal at a low level to the fourth light emitting control line (Em[4]) via the output terminal (Out) thereof, and the fourth light emitting negative control signal at a high level to the fourth light emitting negative control line (EmB[4]) via the negative output terminal (OutB) thereof. Thus, in embodiments of the invention, during the fourth driving period (T4), the operation of the fourth light emitting control driving unit (Emission_4) may be the same as the operation of the light emitting control driving circuit 300, 300' during the first driving period (T51), as described with regard to FIGS. 4 and 9.

During the fifth driving period (T5), the first light emitting control driving unit (Emission_1) may operate in a same manner as it operated during the fourth driving period (T4).

During the fifth driving period (T5), the second light emitting control driving unit (Emission_2) may receive a second clock signal at a low level, a second negative clock signal at a high level, and a first light emitting negative control signal at a high level, and the second light emitting control driving unit (Emission_2) may output the second light emitting control signal at a low level to the second light emitting control line (Em[2]) via the output terminal (Out) thereof, and the second light emitting negative control signal at a high level to the second light emitting negative control line (EmB[2]) via the negative output terminal (OutB) thereof. Thus, in embodiments of the invention, during the fifth driving period (T5), the operation of the second light emitting control driving unit (Emission_2) may be the same as the operation of the light emitting control driving circuit 300, 300' during the third driving period (T53), as described with regard to FIGS. 4 and 9.

During the fifth driving period (T5), the third light emitting control driving unit (Emission_3) may operate in a same manner as it operated during the fourth driving period (T4).

During the fifth driving period (T5), the fourth light emitting control driving unit (Emission_4) may receive a second clock signal at a low level, a second negative clock signal at a high level, and a third light emitting negative control signal at a low level, and the fourth light emitting control driving unit (Emission_4) may output the fourth light emitting control signal at a high level to the fourth light emitting control line (Em[4]) via the output terminal (Out) thereof, and the fourth light emitting negative control signal at a low level to the fourth light emitting negative control line (EmB[4]) via the negative output terminal (OutB) thereof. Thus, in embodiments of the invention, during the fifth driving period (T5), the operation of the fourth light emitting control driving unit (Emission_4) may be the same as the operation of the light emitting control driving circuit 300, 300' during the second driving period (T52), as described with reference to FIGS. 4 and 9.

Further, during the fifth driving period (T5), when the fourth light emitting control signal at a high level may be output by the fourth light emitting control driving unit (Emission_4) to the fourth light emitting control line (Em[4]), the seventh pixel unit (PS_7) and the eighth pixel unit (PS_8) may operation when they respectively receive a scan line at a low level from the seventh scan line (Scan[7]) and the eighth scan line (Scan[8]).

During subsequent driving period(s), e.g., (T6), (T7), etc., operations of the respective light emitting control driving units may substantially correspond to the operations of the first light emitting control driving unit to the fourth light emitting control driving unit (Emission_1 to Emission_4) during the first driving period (T1) to the fifth driving period (T5).

As illustrated above, an organic light emitting display and a driving circuit thereof according to embodiments of the present invention may be advantageous over conventional displays by enabling a size of the driving circuit and a manufacturing cost to be reduced, and a manufacturing yield thereof to be improved as one light emitting control driving line may be electrically coupled to pixels of multiple, e.g., two, rows, and thus a light emitting control signal may be provided to the pixels of multiple, e.g., two, rows simultaneously.

Further, as illustrated above, an organic light emitting display and a driving circuit thereof according to embodiments of the present invention may be advantageous by enabling a manufacturing cost and time to be reduced and for the yield to be improved as the light emitting control driving circuit may be implemented using transistors of only a same type as that of transistor(s) employed for implementing a pixel.

In above explanation, only exemplary embodiments of an organic light emitting display and a driving circuit thereof according to the present invention are explained, but the present invention is not limited to above described embodiments, and it is to be noted that various modifications may be realized by the person having a common knowledge in the art to which the present invention belongs without deviating the scope of the present invention, which is claimed in the claims illustrated as below within the spirit of the present invention.

What is claimed is:

1. A driving circuit including a plurality of light emitting control drivers, comprising:

an input terminal coupled to an initial driving line or a light emitting negative control line of a previous light emitting control driver;

a first clock terminal and a second clock terminal that are electrically coupled to a first clock line and a first negative clock line that are phase-inverted, or a second clock line and a second negative clock line, respectively; and an output terminal and a negative output terminal adapted to generate an output signal and a negative output signal when receiving an input signal, a clock signal and a negative clock signal via the input terminal, the first clock terminal and the second clock terminal, respectively, wherein in odd-numbered ones of the plurality of light emitting control drivers except for a first one of the plurality of light emitting control drivers, the first clock terminal is electrically coupled to the first clock line or the first negative clock line, the second clock terminal is electrically coupled to the first negative clock line or the first clock line, the input terminal is electrically coupled to the light emitting negative control line of the previous light emitting control driver, the output terminal is electrically coupled to an odd-numbered light emitting control line for outputting the light emitting control signal, and the negative output terminal is electrically coupled to the odd-numbered light emitting control line for outputting the light emitting negative control signal, and wherein in even-numbered ones of the plurality of light emitting control drivers, the first clock terminal is electrically coupled to the second clock line or the second negative clock line, the second clock terminal is electrically coupled to the second negative clock line or the second clock line, the input terminal is electrically coupled to the light emitting negative control line of the previous light emitting control driver, the output terminal is electrically coupled to the even -numbered light emitting control line for outputting the light emitting control signal, and the negative output terminal is electrically coupled to the even-numbered light emitting control line for outputting the light emitting negative control signal, wherein each of the light emitting control drivers comprises:

a first switching element electrically coupled between the input terminal and a first power supply line;

a second switching element that includes a control electrode electrically coupled to the first clock terminal, and is electrically coupled between the first switching element and the first power supply line;

a third switching element that includes a control electrode electrically coupled between the first switching element and the second switching element, and is electrically coupled between the second switching element and the second clock terminal;

a fourth switching element that includes a control electrode electrically coupled between the second switching element and the third switching element, and is electrically coupled between the first power supply line and a second power supply line;

a fifth switching element that includes a control electrode electrically coupled to the first clock terminal, and is electrically coupled between the fourth switching element and the second power supply line;

a sixth switching element that includes a control electrode electrically coupled between the fourth switching element and the fifth switching element, and is electrically coupled between the first power supply line and the second power supply line;

a seventh switching element that includes a control electrode electrically coupled between the second switching element and the third switching element, and is electrically coupled between the sixth switching element and the second power supply line;

an eighth switching element that includes a control electrode electrically coupled between the sixth switching element and the seventh switching element, and is electrically coupled between the first power supply line and the second power supply line; and a ninth switching element that includes a control electrode electrically coupled between the fourth switching element and the fifth switching element, and is electrically coupled between the eighth switching element and the second power supply line.

2. The driving circuit as claimed in claim 1, wherein the clock signal is a signal transferred from the first clock line or the second clock line.

3. The driving circuit as claimed in claim 1, wherein the negative clock signal is a signal transferred from the first negative clock line or the second negative clock line.

4. The driving circuit as claimed in claim 1, wherein:

the first clock terminal of a first light emitting control driver of the plurality of light emitting control drivers is electrically coupled to the first clock line, the second clock terminal of the first light emitting control driver of the plurality of light emitting control drivers is electrically coupled to the first negative clock line, the input terminal of the first light emitting control driver of the plurality of light emitting control drivers is electrically coupled to the initial driving line, the output terminal of the first light emitting control driver of the plurality of light emitting control drivers is electrically coupled to the first light emitting control line for outputting the first light emitting control signal, and the negative output terminal of the first light emitting control driver of the plurality of light emitting control drivers is electrically coupled to the first light emitting negative control line for outputting the first light emitting negative control signal.

5. The driving circuit as claimed in claim 1, wherein:

the first clock terminal of a second light emitting control driver of the plurality of light emitting control drivers is electrically coupled to the second clock line, the second clock terminal of the second light emitting control driver of the plurality of light emitting control drivers is electrically coupled to the second negative clock line, the input terminal of the second light emitting control driver of the plurality of light emitting control drivers the is electrically coupled to the first light emitting negative control signal, the output terminal of the second light emitting control driver of the plurality of light emitting control drivers is electrically coupled to the second light emitting control line for outputting the second light emitting control signal, and the negative output terminal of the second light emitting control driver of the plurality of light emitting control drivers is electrically coupled to the second light emitting negative control line for outputting the second light emitting negative control signal.

6. The driving circuit as claimed in claim 1, wherein the first clock terminal of the respective odd-numbered light emitting control driver is electrically coupled to the first clock line when the second clock terminal is electrically coupled to the first negative clock line, and the second clock terminal is electrically coupled to the first clock line when the first clock terminal is electrically coupled to the first negative clock line.

7. The driving circuit as claimed in claim 1, wherein in the even-numbered light emitting control driver, when the first clock terminal is electrically coupled to the second clock line, the second clock terminal is electrically coupled to the second negative clock line, and when the second clock terminal is electrically coupled to the second clock line, the first clock terminal is electrically coupled to the second negative clock line.

8. The driving circuit as claimed in claim 1, wherein a control electrode of the first switching element is electrically coupled to the input terminal, a first electrode of the first switching element is electrically coupled to the control electrode of the third switching element, and a second electrode of the first switching element is electrically coupled to the input terminal.

9. The driving circuit as claimed in claim 1, wherein a control electrode of the first switching element is electrically coupled to the first clock terminal, a first electrode of the first switching element is electrically coupled to the control electrode of the third switching element, and a second electrode of the first switching element is electrically coupled to the input terminal.

10. The driving circuit as claimed in claim 1, wherein the second switching element includes a first electrode electrically coupled to the first power supply line, and a second electrode electrically coupled between the control electrode of the third switching element and the control electrode of the fourth switching element.

11. The driving circuit as claimed in claim 1, wherein the third switching element includes a first electrode electrically coupled between the control electrode of the fourth switching element and the control electrode of the seventh switching element, and a second electrode electrically coupled to the second clock terminal.

12. The driving circuit as claimed in claim 1, wherein the fourth switching element includes a first electrode electrically coupled to the first power supply line, and a second electrode electrically coupled between the first electrode of the fifth switching element and the control electrode of the sixth switching element.

13. The driving circuit as claimed in claim 1, wherein the fifth switching element includes a first electrode electrically coupled between the control electrode of the sixth switching element and the control electrode of the ninth switching element, and a second electrode electrically coupled to the second power supply line.

14. The driving circuit as claimed in claim 1, wherein the sixth switching element includes a first electrode electrically coupled to the first power supply line, and a second electrode electrically coupled between the first electrode of the seventh switching element and the control electrode of the eighth switching element.

15. The driving circuit as claimed in claim 1, wherein the seventh switching element includes a first electrode electrically coupled between the control electrode of the eighth switching element and the first light emitting negative control line, and a second electrode electrically coupled to the second power supply line.

16. The driving circuit as claimed in claim 1, wherein the eighth switching element includes a first electrode electrically coupled to the first power supply line, and a second electrode electrically coupled to the first light emitting control line.

17. The driving circuit as claimed in claim 1, wherein the ninth switching element includes a first electrode electrically coupled to the first light emitting control line, and a second electrode electrically coupled to the second power supply line.

18. The driving circuit as claimed in claim 1, further comprising a first storage capacitor including a first electrode electrically coupled to the control electrode of the third switching element and a second electrically coupled between the second switching element and the third switching element.

19. The driving circuit as claimed in claim 1, further comprising a second storage capacitor including a first electrode electrically coupled between the control electrode of the ninth switching element and the control electrode of the sixth switching element, and a second electrode electrically coupled between the eighth switching element, the ninth switching element, and the first power supply line.

20. An organic light emitting display comprising the driving circuit as claimed in claim 1.

21. An organic light emitting display, comprising:

a first light emitting control driver electrically coupled to an initial driving line, a first clock line, and a first negative clock line, and adapted to output a first light emitting control signal via a first light emitting control line and a first light emitting negative control signal via a first light emitting negative control line;

a first pixel unit electrically coupled to the first light emitting control line;

a second pixel unit electrically coupled to the first light emitting control line;

a second light emitting control driver electrically coupled to the first light emitting negative control line, a second clock line, and a second negative clock line, and adapted to output a second light emitting control signal via a second light emitting control line and a second light emitting negative control signal via a second light emitting negative control line;

a third pixel unit electrically coupled to the second light emitting control line; and a fourth pixel unit electrically coupled to the second light emitting control line, wherein each of the first and second light emitting control drivers includes:

a first switching element electrically coupled between an input terminal and a first power supply line;

a second switching element that includes a control electrode electrically coupled to a first clock terminal, and is electrically coupled between the first switching element and a first power supply line;

a third switching element that includes a control electrode electrically coupled between the first switching element and the second switching element, and is electrically coupled between the second switching element and a second clock terminal;

a fourth switching element that includes a control electrode electrically coupled between the second switching element and the third switching element, and is electrically coupled between the first power supply line and a second power supply line;

a fifth switching element that includes a control electrode electrically coupled to the first clock terminal, and is electrically coupled between the fourth switching element and the second power supply line;

a sixth switching element that includes a control electrode electrically coupled between the fourth switching element and the fifth switching element, and is electrically coupled between the first power supply line and the second power supply line;

a seventh switching element that includes a control electrode electrically coupled between the second switching element and the third switching element, and is electrically coupled between the sixth switching element and the second power supply line;

an eighth switching element that includes a control electrode electrically coupled between the sixth switching element and the seventh switching element, and is electrically coupled between the first power supply line and the second power supply line; and a ninth switching element that includes a control electrode electrically coupled between the fourth switching element and the fifth switching element, and is electrically coupled between the eighth switching element and the second power supply line.

* * * * *